US008007326B2

(12) United States Patent
Urano

(10) Patent No.: US 8,007,326 B2
(45) Date of Patent: Aug. 30, 2011

(54) CONNECTOR CAPABLE OF SUPPRESSING BOARD—INDUCED CONTACT DAMAGE

(75) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 116 days.

(21) Appl. No.: 12/482,879

(22) Filed: Jun. 11, 2009

(65) Prior Publication Data

US 2009/0318006 A1 Dec. 24, 2009

(30) Foreign Application Priority Data

Jun. 18, 2008 (JP) ..... 2008-159027

(51) Int. Cl.
*H01R 13/40* (2006.01)

(52) U.S. Cl. ..... 439/750; 362/97.1

(58) Field of Classification Search ..... 439/750, 439/267, 225, 239, 568; 362/97.1, 97.2, 362/217.01, 217.02

See application file for complete search history.

(56) References Cited

U.S. PATENT DOCUMENTS 3,899,234 A * 8/1975 Yeager et al. ..... 439/267
7,347,705 B1 * 3/2008 Huang et al. ..... 439/231
7,637,625 B2 * 12/2009 Kwon et al. ..... 362/97.2
7,651,354 B2 * 1/2010 Kim ..... 439/226

FOREIGN PATENT DOCUMENTS

JP 2004-335227 A 11/2004

* cited by examiner

*Primary Examiner* — T C Patel
*Assistant Examiner* — Phuongchi T Nguyen
(74) *Attorney, Agent, or Firm* — Holtz, Holtz, Goodman & Chick, PC

(57) ABSTRACT

A connector capable of preventing a contact portion of a contact from being damaged. The contact is held by a housing having an accommodating portion for accommodating an inserting portion of an inverter board. The contact has a contact portion which is capable of being brought into contact with the inserting portion accommodated in the accommodating portion along the direction of the thickness of the inverter board. A slider which brings the contact portion of the contact into and out of contact with the inserting portion of an inverter board by sliding is slidably mounted on the housing.

14 Claims, 17 Drawing Sheets

CONNECTOR CAPABLE OF SUPPRESSING BOARD—INDUCED CONTACT DAMAGE

BACKGROUND OF THE INVENTION

1. Field of the Invention

This invention relates to a connector, and more particularly to a connector for use in e.g. a liquid-crystal display.

2. Description of the Related Art

Conventionally, there has been proposed a lamp-holding structure for connecting a lamp and an inverter board (see Japanese Laid-Open Patent Publication (Kokai) No. 2004-335227). The lamp-holding structure is comprised of a contact, a lamp-holding member, and a covering member.

The contact is comprised of a pressure contact portion, a contact spring portion, a holding portion, and a connection portion. The pressure contact portion is brought into pressure contact with a lamp terminal of the lamp held by the covering member. The contact spring portion is opposed to a holding board disposed at the top end surface of the lamp holding member in the direction of the thickness of the holding board. Further, the contact spring portion is movable in the vertical direction. The front end of the contact spring portion is warped upward. The holding portion is press-fitted in the lamp holding member. Thus, the contact is held by the lamp holding member. The connection portion connects between the pressure contact portion and the contact spring portion.

The lamp holding member has a first accommodating portion for accommodating the covering member and the connection portion of the contact.

The covering member has a lamp accommodating portion for accommodating one end of the lamp and a terminal inserting portion into which a lamp terminal of the lamp is inserted.

To hold the lamp by the lamp-holding structure, first, by press-fitting the holding portion of the contact in the lamp holding member, the contact is caused to be held by the lamp holding member. When the contact is held by the lamp holding member, the connection portion of the contact is received into the first accommodating portion of the lamp holing member.

Next, the lamp terminal of the lamp is inserted into the terminal inserting portion of the covering member, and one end of the lamp is received into the lamp accommodating portion of the covering member.

Finally, the covering member is received into the first accommodating portion of the lamp holing member. When the covering member is received into the first accommodating portion, the pressure contact portion of the contact is brought into pressure contact with the lamp terminal of the lamp.

To electrically connect between the lamp and the inverter board by the lamp-holding structure, it is only necessary to insert one end of the inverter board between the holding board disposed on the upper end surface of the lamp holding member and the contact spring portion of the contact along the upper end surface of the lamp holding member. As described above, since the front end of the contact spring portion of the contact is warped upward, when one end of the inverter board is inserted between the holding board and the contact spring portion of the contact along the upper end surface of the lamp holding member, the contact spring portion smoothly climbs onto the upper surface of the inverter board.

In the above-described lamp-holding structure, when inserting one end of the inverter board between the holding board and the contact spring portion of the contact along the upper end surface of the lamp holding member, there is a fear that the contact spring portion does not normally climb onto the inverter board but is pressed against the inverter board, causing the contact spring portion to be bent.

SUMMARY OF THE INVENTION

The present invention has been made in view of these circumstances, and an object thereof is to provide a connector which is free from a fear of a contact portion of a contact from being broken.

To attain the above object, in a first aspect of the present invention, there is provided a connector comprising a housing that has an accommodating portion into which part of a board is inserted, a contact that has a contact portion which is capable of being brought into contact with the part of the board accommodated in the accommodating portion, and is held by the housing, and a slider that is slidably provided in the housing, and brings the contact portion into and out of contact with the part of the board in a direction of thickness of the board, by sliding.

With the arrangement of the connector according to the first aspect of the present invention, since the contact portion of the contact is brought into and out of contact with the part of the board in the direction of the thickness of the board by sliding the slider, it is possible to prevent the contact portion from being brought into contact with the part of the board when the part of the board is received in the accommodating portion.

Further, the contact portion is capable of being brought into contact with the part of the board in the direction of the thickness of the board, and hence there is no fear of the contact portion being urged in a direction parallel to the mounting surface of the board.

Preferably, the slider has a cam surface for moving the contact portion in the direction of the thickness, and wherein the contact has an engaging portion for being engaged with the cam surface.

Preferably, the housing has a guiding portion for guiding the slider in a sliding direction thereof.

Preferably, the contact has a guiding portion for guiding the slider in a sliding direction thereof.

Preferably, the housing has an opening for receiving the part of the board in the accommodating portion in the direction of the thickness, and the slider has a lid portion that opens and closes the opening by sliding.

To attain the above object, in a second aspect of the present invention, there is provided a connector comprising a housing that has an accommodating portion into which part of a board is inserted into a direction of thickness of the board, and an opening for receiving part of the board in the accommodating portion in the direction of the thickness of the board, a contact that has a contact portion which is capable of being brought into contact with the part of the board inserted in the accommodating portion, and a sandwiching portion for sandwiching the part of the board inserted in the accommodating portion and pushing the part against the contact portion, and is held by the housing, and a slider that is mounted on the housing in a manner slidable between an opening position at which the opening is opened and a closing position at which the opening is closed, for maintaining a state of the part of the board sandwiched by the sandwiching portion when the slider is at the closing position, and releasing the state of the part of the board sandwiched by the sandwiching portion when the slider is at the opening position.

Preferably, the housing has a guiding portion for guiding the slider in a sliding direction thereof.

Preferably, the slider has a lid portion that opens and closes the opening by insertion and removal of the part of the board into and from the accommodating portion of the housing.

According to the present invention, it is possible to provide a connector which is free from a fear of a contact portion of a contact from being damaged.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
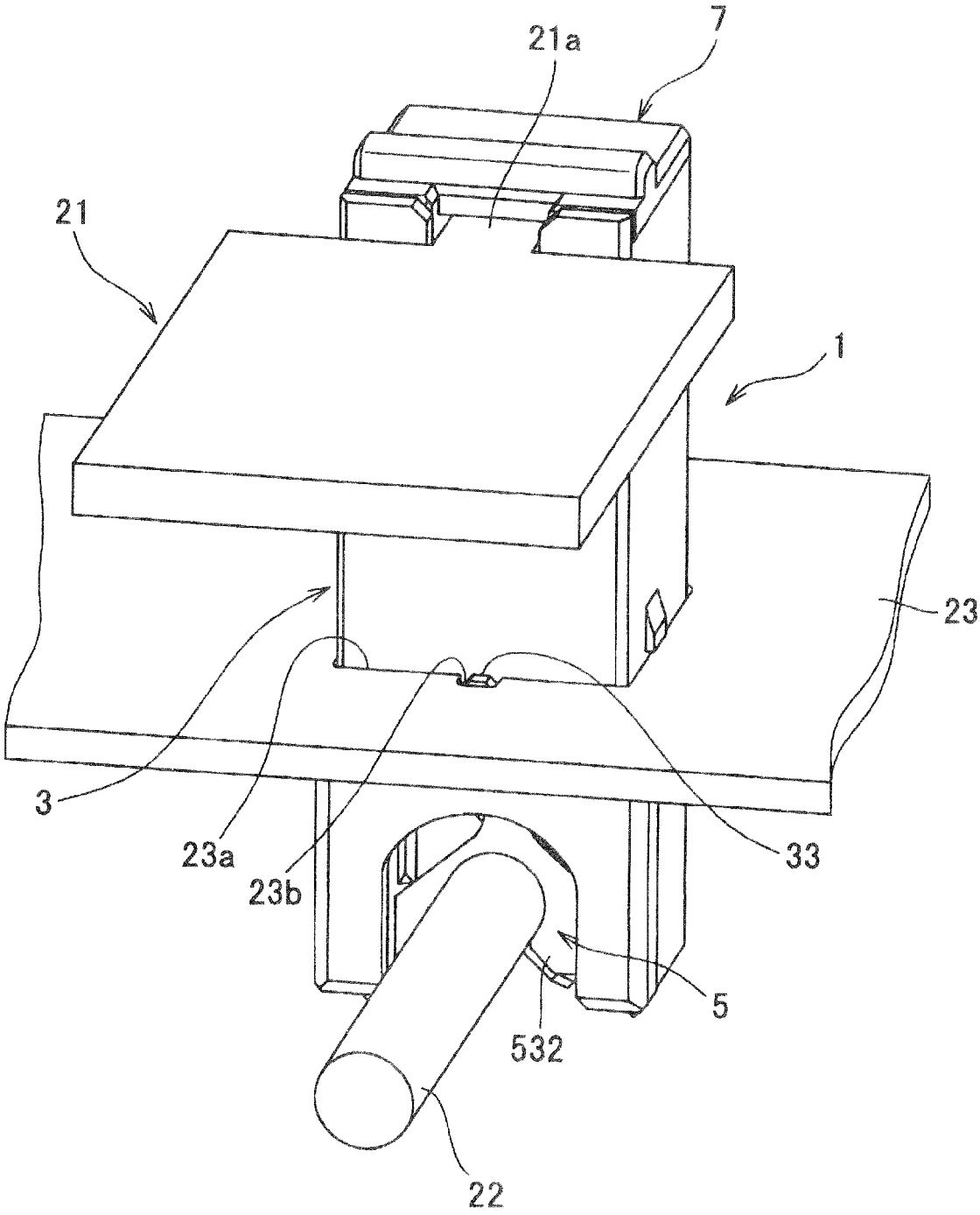
FIG. 1 is a perspective view of a connector according to a first embodiment of the present invention, in a state of use.

As shown in FIG. 1, a connector 1 is mounted on a chassis 23 of a liquid-crystal display to electrically connect an inverter board 21 and a cold-cathode tube 22 of a backlight. The connector 1 is comprised of a housing 3, a contact 5, and a slider 7.

Figure 2:
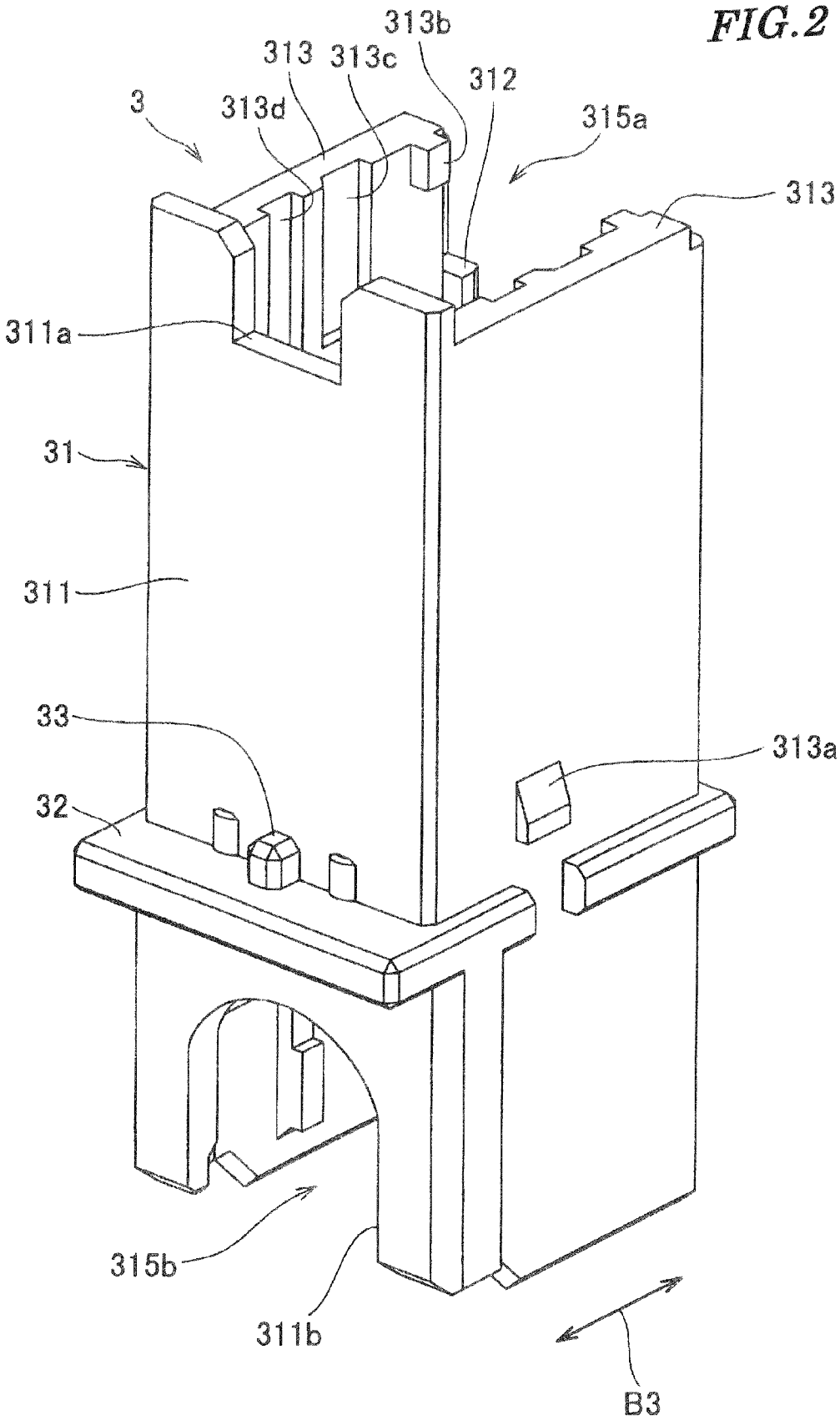
FIG. 2 is a perspective view of a housing of the FIG. 1 connector.
Figure 3:
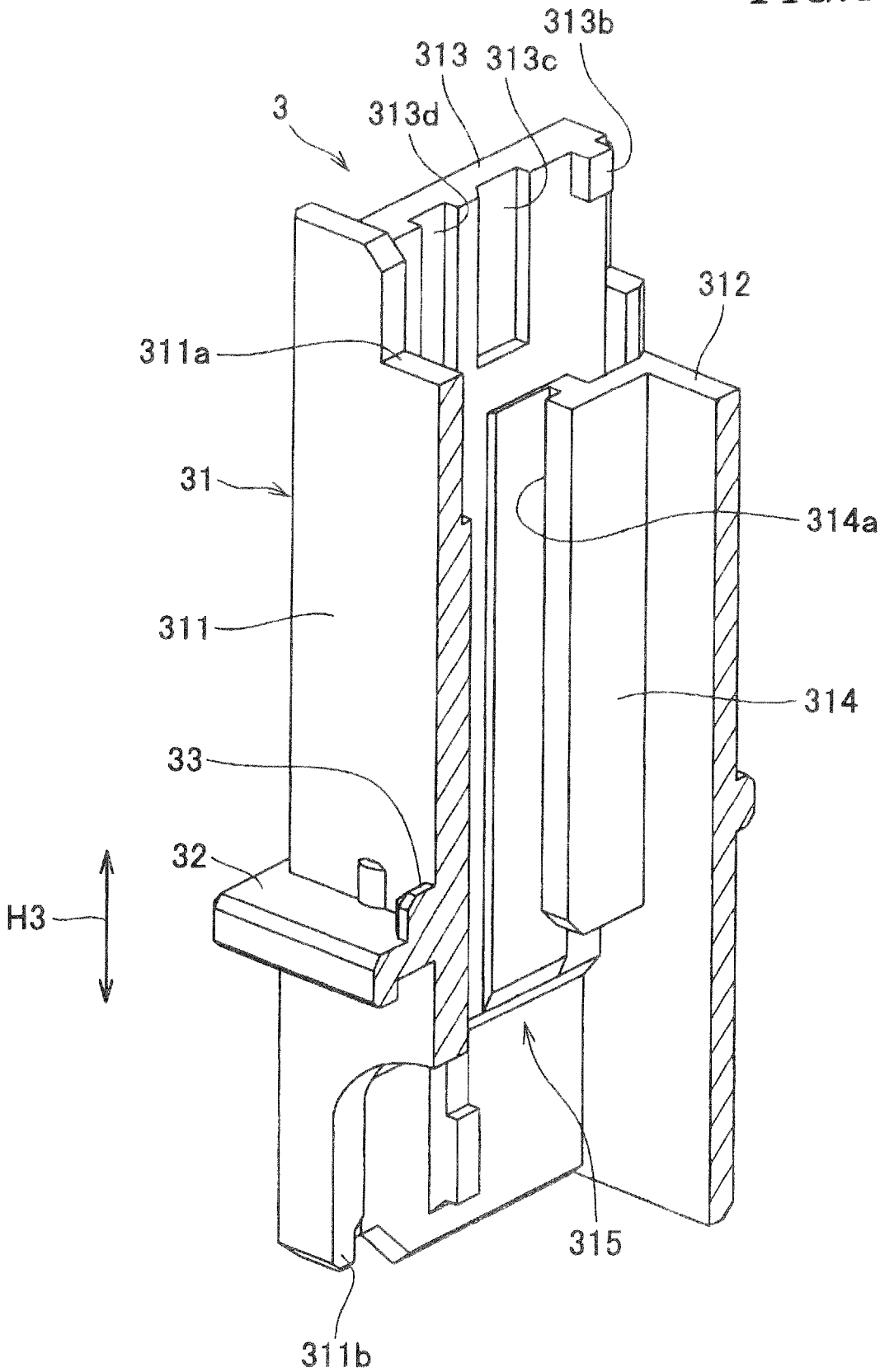
FIG. 3 is a perspective view, partly in cross-section, of the FIG. 1 connector.

As shown in FIGS. 2 and 3, the housing 3 includes a housing body 31 and a flange 32, and is made of a resin having insulation properties. The housing body 31 has a hollow prism shape, and includes a front board 311, a rear board 312, and two side boards 313. The housing body 31 has a substantially rectangular cross sectional.

The front board 311 has an upper end portion formed with an opening 311*a*, and a lower end portion formed with an opening 311*b*.

The rear board 312 is formed such that an upper end surface thereof is lower than an upper end surface of the front board 311. The rear board 312 has an inner surface provided projecting portions 314 at both sides thereof. Each projecting portion 314 extends in the direction H3 of the height of the housing 3. By connecting a front end of each projecting portion 314 to each side board 313, a holding groove 314*a* is formed at the front end of each projecting portion 314. The holding groove 314*a* extends in the direction H3 of the height of the housing 3.

Two side boards 313 have a same shape. Each side board 313 has an outer surface formed with a wedge-like protrusion 313*a* in a substantially central part thereof. Each side board 313 has an inner surface formed with a protruding portion (guiding portion) 313*b* on the upper portion. Further, each side board 313 has an upper portion having two recesses 313*c* and 313*d* formed in an inner surface thereof.

A space surrounded by the front board 311, the rear board 312, and two side boards 313 (inner space of the housing body 31) is an accommodating space (accommodating portion) 315 which accommodates part of the inverter board 21.

The flange 32 is formed on the outer surface of the housing body 31. The flange 32 is located slightly below the protrusions 313*a* in the direction H3 of the height of the housing 3.

The flange 32 has an upper surface formed with a wrong insertion-preventing protruding portion 33.

Figure 4:
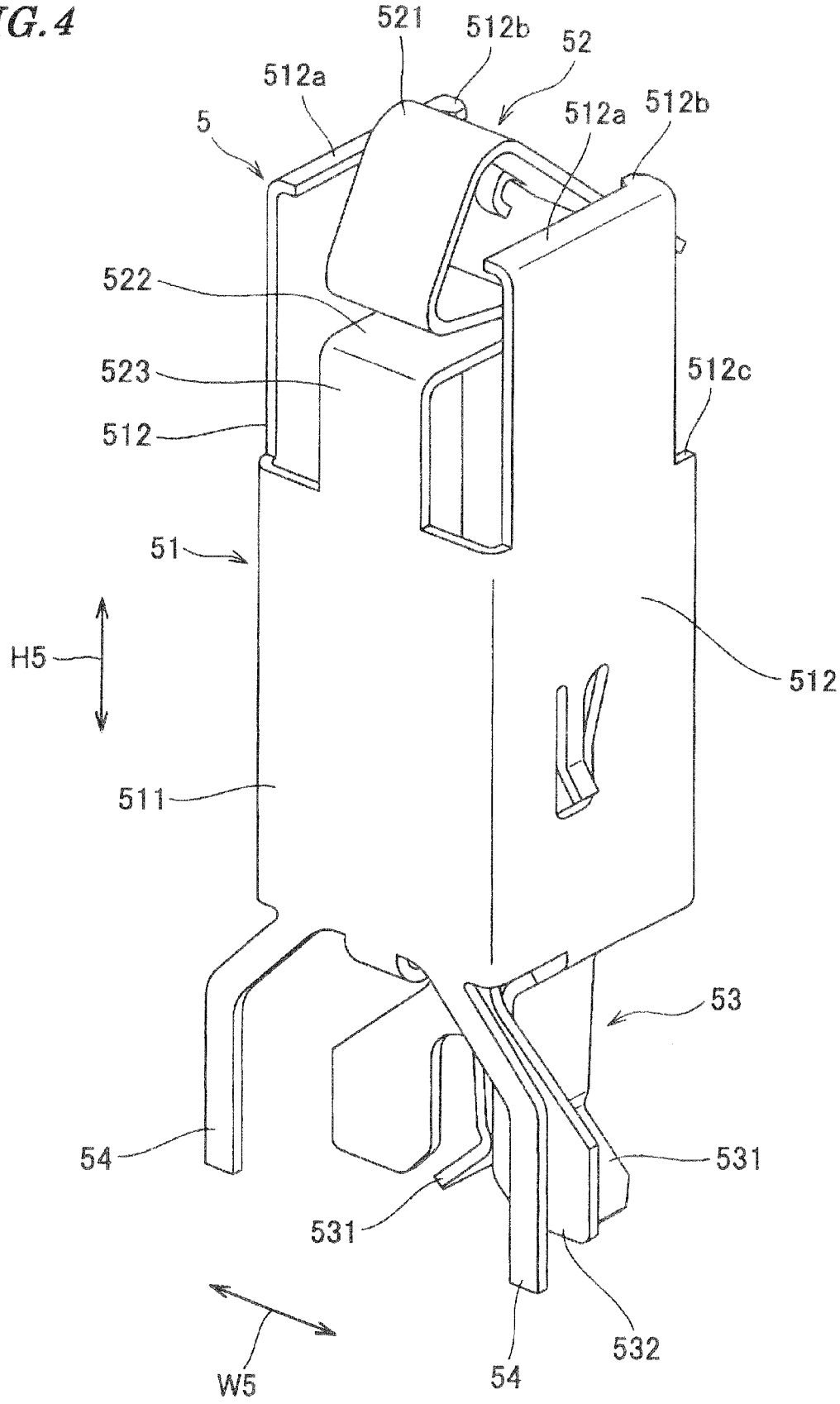
FIG. 4 is a perspective view of a contact of the FIG. 1 connector, as taken obliquely from the front.
Figure 5:
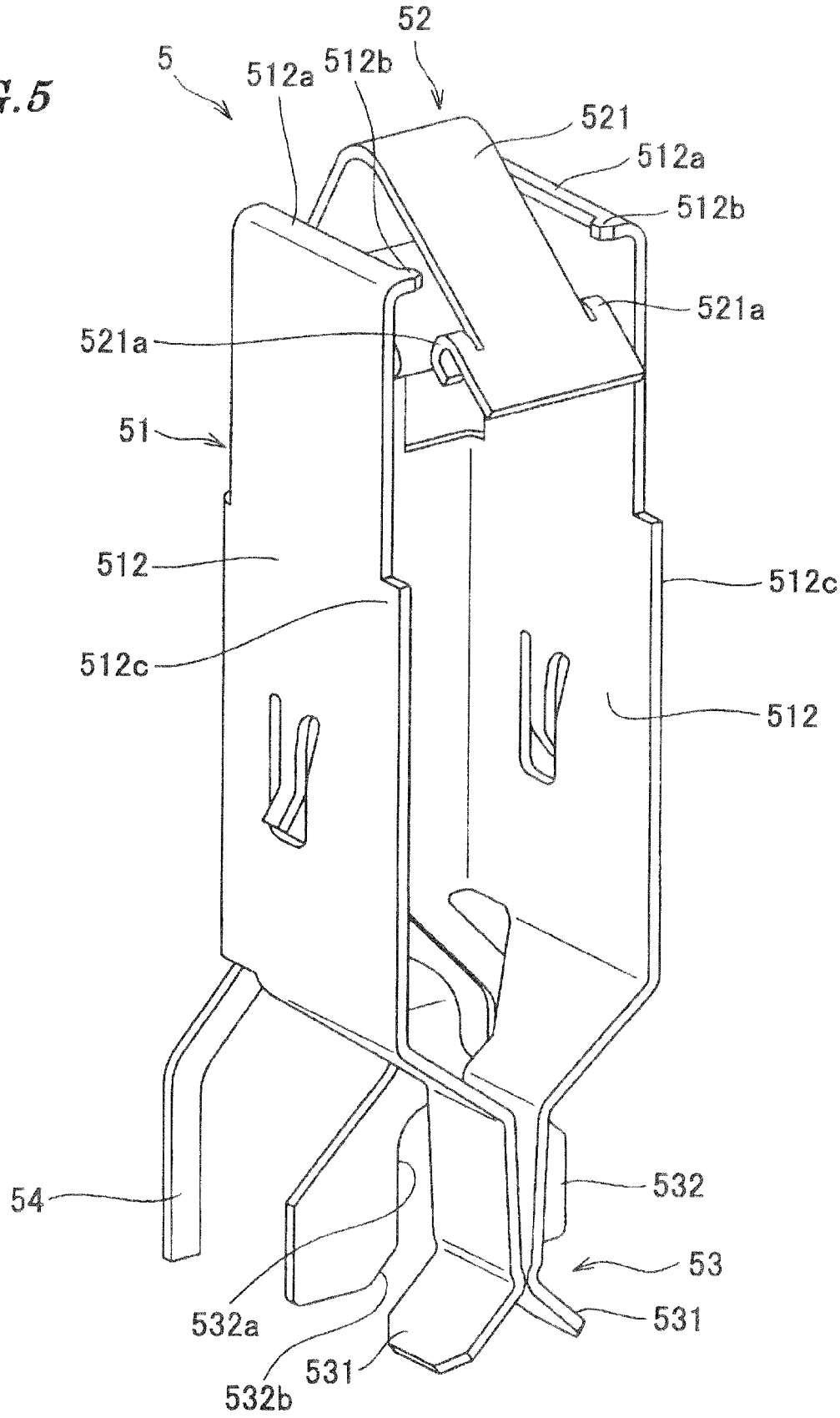
FIG. 5 is a perspective view of the contact of the FIG. 1 connector, as taken obliquely from the rear.

As shown in FIGS. 4 and 5, the contact 5 includes a barrel portion 51, a board connection portion 52, a cold-cathode tube connection portion 53, and two leg portions 54. The contact 5 is formed by blanking and bending a metal plate.

The barrel portion 51 is comprised of a front board 511 and two side boards 512. The two side boards 512 are continuous respectively to the opposite side portions of the front board 511. The height dimension of the side board 512 is larger than that of the front board 511, and an upper end of the side board 512 is positioned higher than the upper end of the front board 511. The upper end of each side board 512 is bent inward substantially at right angles to form a rail (guiding portion) 512*a*. The rail 512*a* has a rear end formed with a protruding portion 512*b*.

The board connection portion 52 has a contact portion 521, a spring portion 522, and a supporting portion 523. The contact portion 521 is bent into a substantially L-shape. The contact portion 521 has two engaging portions 521*a*. The engaging portion 521*a* is formed into a substantially J-shape, and is located at a front end (one end) of the contact portion 521. The spring portion 522 has one end which is bent into a substantially U-shape, and is continuous to the other end of the contact portion 521. The spring portion 522 is elastically deformable in the direction H5 of the height of the contact 5. The supporting portion 523 has a plate-like shape, and has one end continuous to the other end of the spring portion 522, and the other end continuous to the upper end of the front board 511. The supporting portion 523 supports the spring portion 522.

The cold-cathode tube connection portion 53 includes two contact portions 531 and a tube holding portion 532. The two contact portions 531 are bent into a substantially J-shape. Each of the contact portions 531 is elastically deformable in the direction W5 of the width of the contact 5. An upper end of each contact portion 531 is continuous to the lower end of each side board 512. The lower ends of the contact portions 531 are brought into contact with each other. The tube holding portion 532 has a lower part thereof formed into a bifurcated shape. The tube holding portion 532 has a lower part formed with a cutout 532*a* including a portion 532*b* chamfered such that the cold-cathode tube 22 can be easily inserted. The upper part of the tube holding portion 532 is substantially belt-like, bent into a crank-shape, and is continuous to the lower end of the front board 511.

Each of two leg portions 54 is substantially L-shaped, and is continuous to the lower part of the front board 511.

Figure 6:
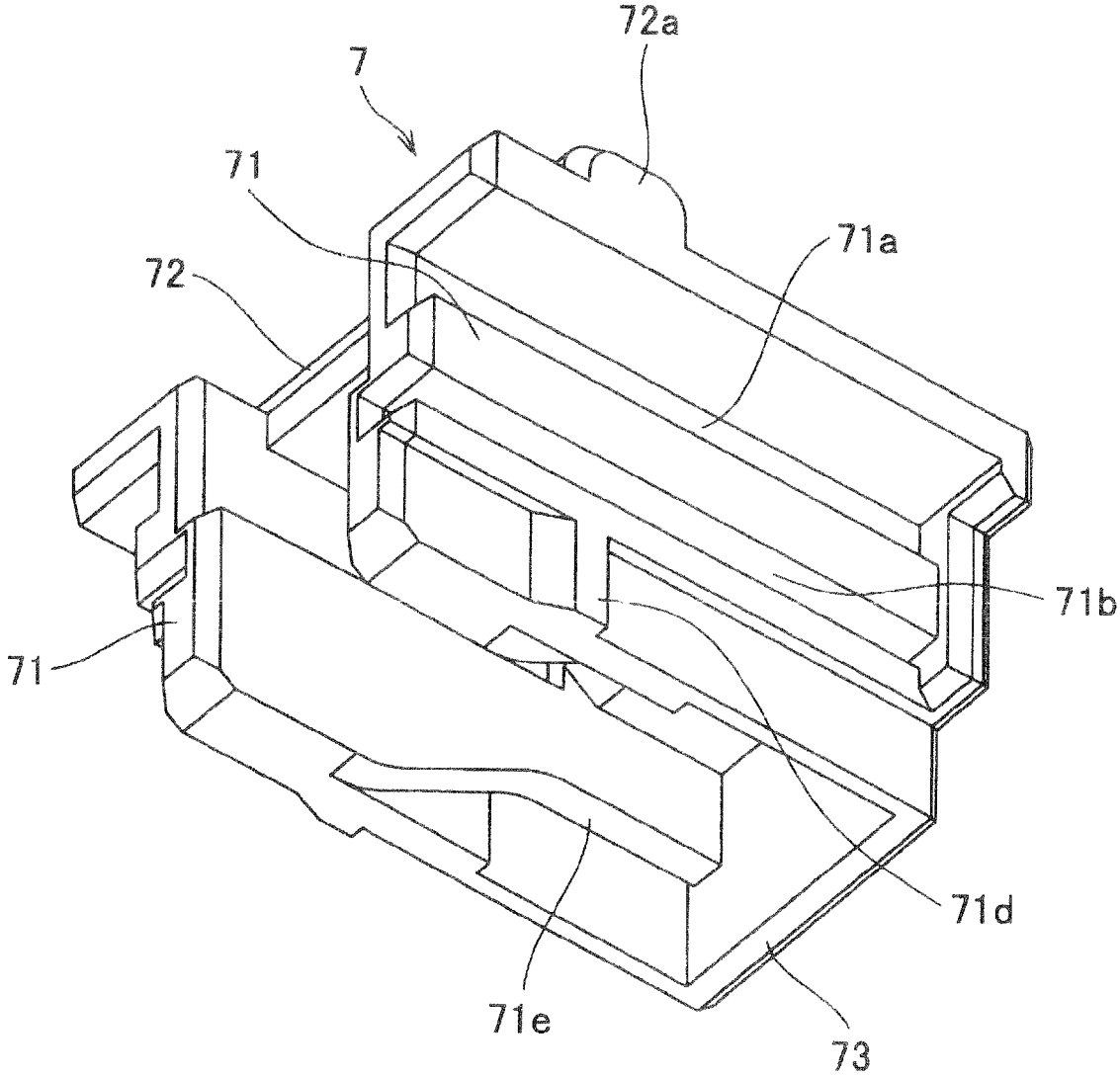
FIG. 6 is a perspective view of a slider of the FIG. 1 connector, as taken obliquely from the bottom.
Figure 7:
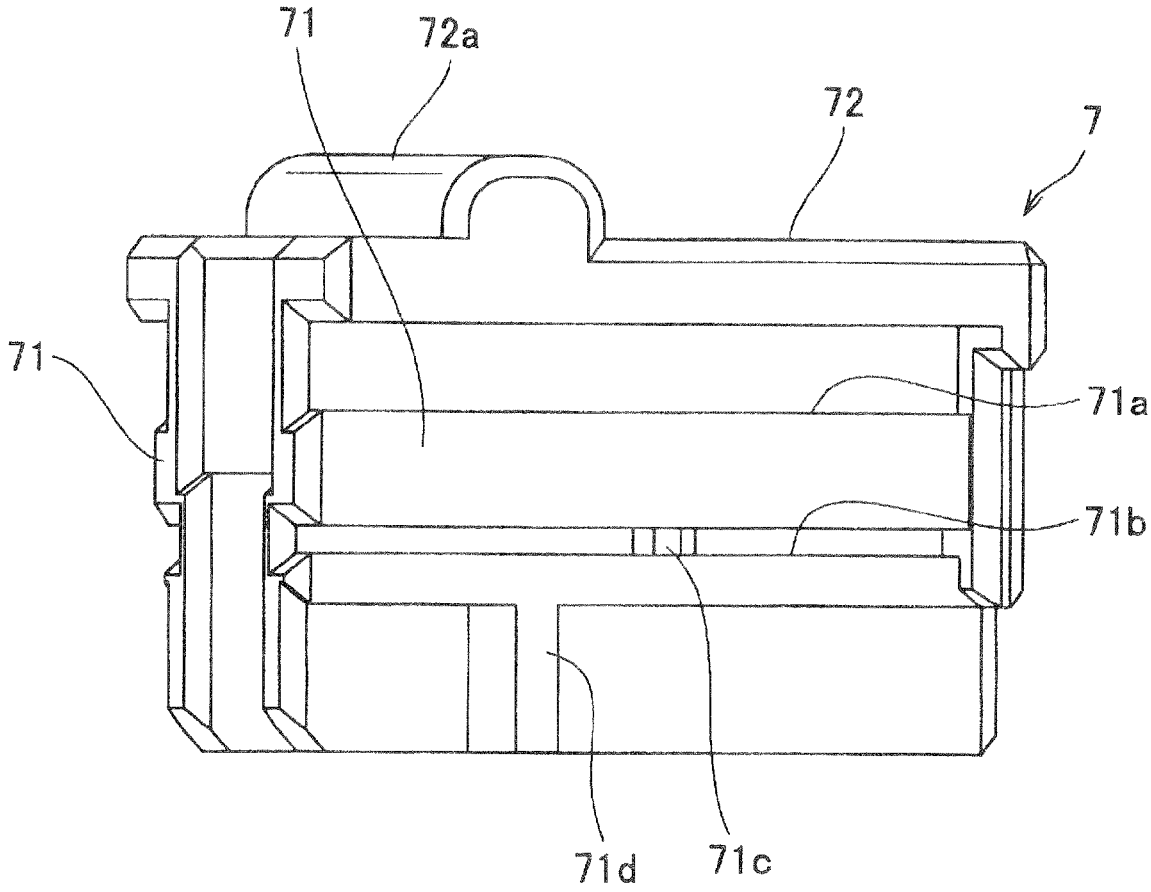
FIG. 7 is a perspective view of the slider of the FIG. 1 connector, as taken obliquely from a lateral side.
Figure 8:
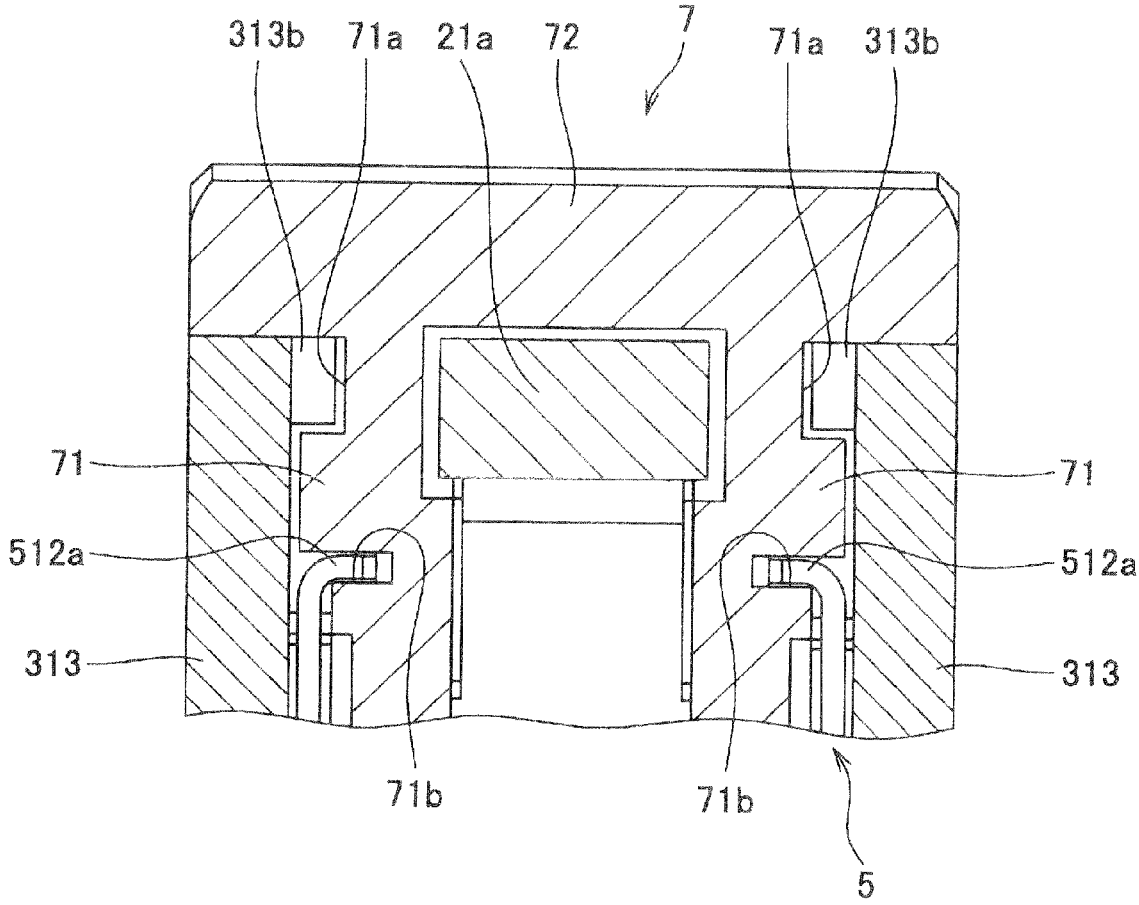
FIG. 8 is a partial sectional view of the slider, the housing, and the contact in an assembled state.

As shown in FIGS. 6 to 8, the slider 7 includes two side wall portions 71, a lid portion 72, and a rear wall portion 73, and is integrally molded from a synthetic resin. Each side wall portion 71 has an outer surface formed with a first groove 71*a* and a second groove 71*b*. The first groove 71*a* and the second groove 71*b* are parallel to each other. The second groove 71*b* has a recess 71*c* formed in the central part thereof. The protruding portion 313*b* of the side board 313 of the housing 3 is inserted into the first groove 71*a* in a relatively slidable manner, and the rail 512*a* of the contact 5 is inserted into the second groove 71*b* in a relatively slidable manner. With this configuration, the slider 7 is fixed to the housing 3 in a manner slidable in a front-rear direction B3 of the housing 3 (see FIG. 2).

Further, each side wall portion 71 has an outer surface formed with a protruding portion 71*d* having a wedge-like shape. When the slider 7 is slid in the front-rear direction B3, the protruding portions 71*d* are slightly fitted in the recesses 313*c* or 313*d* (see FIG. 2) of the side boards 313.

Further, each side wall portion 71 has a lower portion formed with a cam face 71*e*. The cam face 71*e* is engaged with the engaging portion 521*a* of the contact portion 521 of the contact 5 (see FIGS. 4 and 5), and moves the contact portion 521 in the direction of the thickness of an inserting portion 21*a* of the inverter board 21 which is inserted into the accommodating space 315 of the housing 3.

The lid portion 72 is connected to the upper portions of the two side wall portions 71.

The rear wall portion 73 is continuous to the rear portions of the side wall portions 71.

Next, a description will be given of assembling the connector 1. First, the contact 5 (see FIGS. 4 and 5) is inserted from the opening 311*b* formed in the bottom of the housing 3 (see FIGS. 2 and 3). At this time, rear portions 512*c* of the side boards 512 of the contact 5 are inserted into the holding grooves 314*a* of the housing 3 (see FIG. 3). The contact 5 is held in the housing 3 by inserting the rear portions 512*c* of the side boards 512 in the holding grooves 314*a* of the housing 3.

Next, the slider 7 is assembled to the housing 3 and the contact 5 from the rear side of the housing 3. At this time, as shown in FIGS. 2, 7, and 5, the protruding portions 313*b* of the housing 3 are inserted into the first grooves 71*a* of the slider 7, and the rails 512*a* of the contact 5 are inserted into the second grooves 71*b* of the slider 7, respectively.

Finally, the slider 7 is slid forward (in the direction toward the front board 311 of the housing 3), to fit the protruding portions 71*d* of the slider 7 shown in FIG. 6 in the recesses 313*c* or 313*d* of the housing 3 shown in FIG. 2. If the protruding portions 71*d* are fitted in the recesses 313*c*, the slider 7 is stopped at an opening position. When the slider 7 is in this opening position, it is possible to insert or remove the inserting portion 21*a* of the inverter board 21 in the front-rear direction B3 of the housing 3 (see FIG. 2) and in the direction of the height H3 of the housing 3 (see FIG. 3). If the protruding portions 71*d* are fitted in the recesses 313*d*, the slider 7 is stopped at the connection position. When the slider 7 is in the connection position, an opening 315*a* of the accommodating space 315 of the housing 3 (see FIG. 2) is completely covered by the lid portion 72 of the slider 7.

The operations described above completes assembly of the connector 1. After assembling the connector 1, when the slider 7 is slid backward for a predetermined distance by the wrong operation or the like, the slider 7 is locked by fitting the protruding portions 512*b* of the contact 5 in the recesses 71*c* of the slider 7 (see FIG. 7), whereby the slider 7 is prevented from falling off from the housing 3.

The assembled connector 1, as shown in FIG. 1, is fixed to the chassis 23 of the backlight of the liquid-crystal display. To fix the connector 1 to the chassis 23, it is only necessary to insert the connector 1 in a hole 23*a* of the chassis 23 from the bottom of the chassis 23 to bring the flange 32 (see FIG. 2) of the housing 3 of the connector 1 into abutment with the chassis 23. If the connector 1 is inserted until the flange 32 is brought into abutment with the chassis 23, the protrusions 313*a* of the housing 3 of the connector 1 pass through the hole 23*a* of the chassis 23, while being elastically deformed, and after passing through the hole 23*a*, the lower surfaces of the protrusions 313*a* are brought into contact with the upper surface of the chassis 23. As a result, the chassis 23 is sandwiched by the flange 32 and the protrusions 313*a*, whereby the connector 1 is held by the chassis 23.

When inserting the connector 1 into the hole 23*a* of the chassis 23, if the connector 1 is set in the wrong direction, the wrong insertion-preventing protruding portion 33 of the housing 3 of the connector 1 is not inserted into the a recess 23*b* (see FIG. 1) formed in the rim of the hole 23*a* of the chassis 23, which makes the user aware that the connector 1 is set in the wrong direction.

Before inserting the inverter board 21 into the accommodating space 315 of the housing 3 of the connector 1, one end of the cold-cathode tube 22 is caused to be held by the tube holding portion 532 of the contact 5 of the connector 1 (see FIG. 1) in advance, and a pin-like terminal portion (not shown) of the cold-cathode tube 22 is caused to be sandwiched by the two contact portions 53.

To connect the inverter board 21 to the connector 1, first, the protruding portions 71*d* (see FIG. 6) of the slider 7 are fitted in the recesses 313*c* of the housing 3 to place the slider 7 in the opening position. When the slider 7 is in the opening position, the cam surface 71*e* of the slider 7 urges the engaging portions 521*a* of the contact portion 521 of the contact 5 downward to cause the spring portion 522 of the contact 5 to be elastically deformed, whereby the contact portion 521 is in a lower position (lower than the opening 311*a*).

Figure 9:
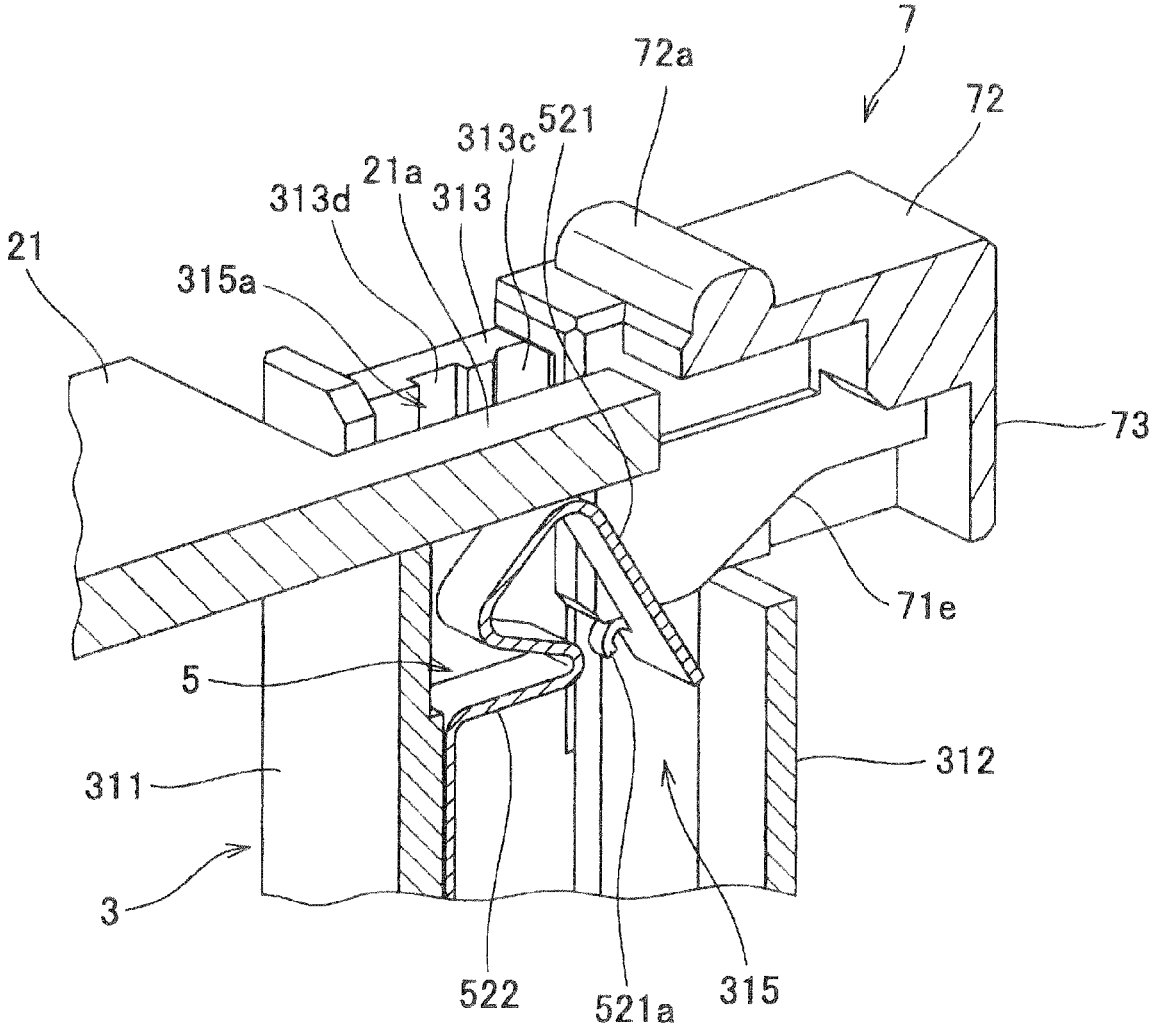
FIG. 9 is a perspective view, partly in cross-section, of the FIG. 1 connector in a state in which the slider is slid from a closing position to an opening position, whereby an inserting portion of an inverter board is inserted into an opening of an accommodating space of the housing of the connector.

Next, as shown in FIG. 9, the inserting portion 21*a* of the inverter board 21 is inserted into the accommodating space 315 of the housing 3 along the front-rear direction B3 or the direction H3 of the height of the housing 3. At this time, the contact portion 521 of the contact 5 is not brought into contact with the inserting portion 21*a* of the inverter board 21.

Figure 10:
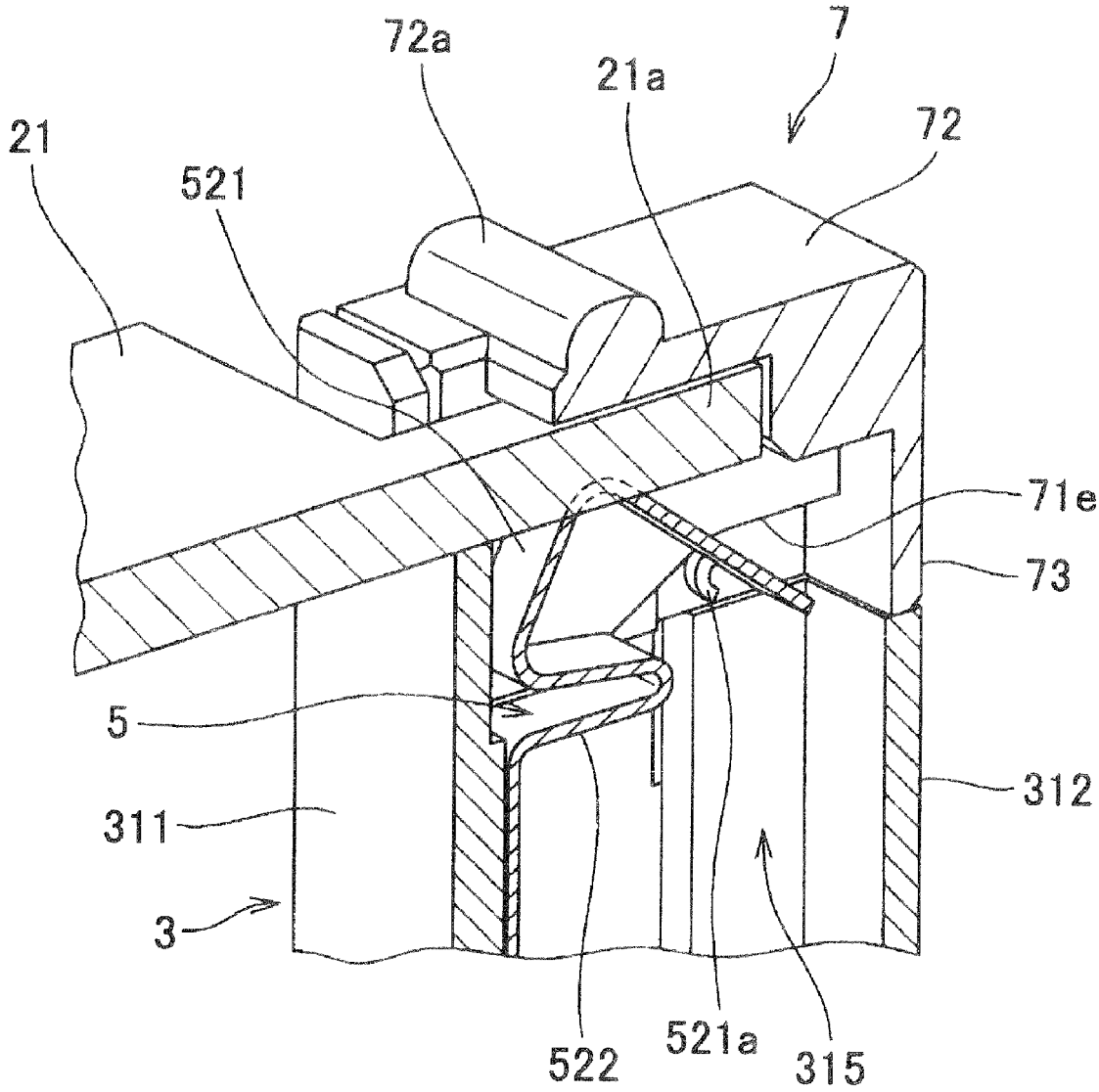
FIG. 10 is a perspective view, partly in cross-section, of the FIG. 1 connector in a state in which the slider is slid from the opening position to the closing position, whereby a contact portion of the contact is brought into contact with the inserting portion of the inverter board.

Finally, the slider 7 is slid forward along the front-rear direction B3 of the housing 3 (in the direction toward the front board 311). As a result, the protruding portions 71*d* of the slider 7 (see FIG. 6) are fitted in the recesses 313*d* of the housing 3, as shown in FIG. 10, whereby the slider 7 is stopped at the closing position. As the slider 7 is slid from the opening position to the closing position, the engaging portions 521*a* of the contact portion 521 of the contact 5 move upward, while relatively sliding on the cam surface 71*e* of the slider 7, so that the amount of deformation of the spring portion 522 is progressively reduced, and the contact portion 521 progressively rises in the direction of the thickness of the inverter board 21 by the spring force of the spring portion 522 until the contact portion 521 is finally brought into contact with the inserting portion 21*a*. When the contact portion 521 of the contact 5 is pushed against the inserting portion 21*a* by the spring force of the spring portion 522, the inverter board 21 and the cold-cathode tube 22 are electrically connected to each other via the contact 5.

When the slider 7 is slid to the closing position, the opening 315*a* of the accommodating space 315 of the housing 3 is covered by the lid portion 72 of the slider 7, so that the inserting portion 21*a* of the inverter board 21 cannot be pulled out in the direction H3 of the height of the housing 3.

As described above, according to the first embodiment, the contact portion 521 of the contact 5 is moved in the direction of the thickness of the inverter board 21 to be brought into contact with the inverter board 21, so that dust is hardly generated during work of connecting the contact 5 and the inverter board 21.

Further, when the slider 7 is slid to the closing position, the opening 315*a* of the accommodating space 315 of the housing 3 is covered by the lid portion 72 of the slider 7, which makes it possible to prevent dust from entering the accommodating space 315 from outside.

Moreover, since the protrusions 313*a* are provided on the outer surface of the housing 3, the connector 1 can be directly mounted on the chassis 23, which makes it possible to easily mount the connector 1 on the chassis 23.

Figure 11:
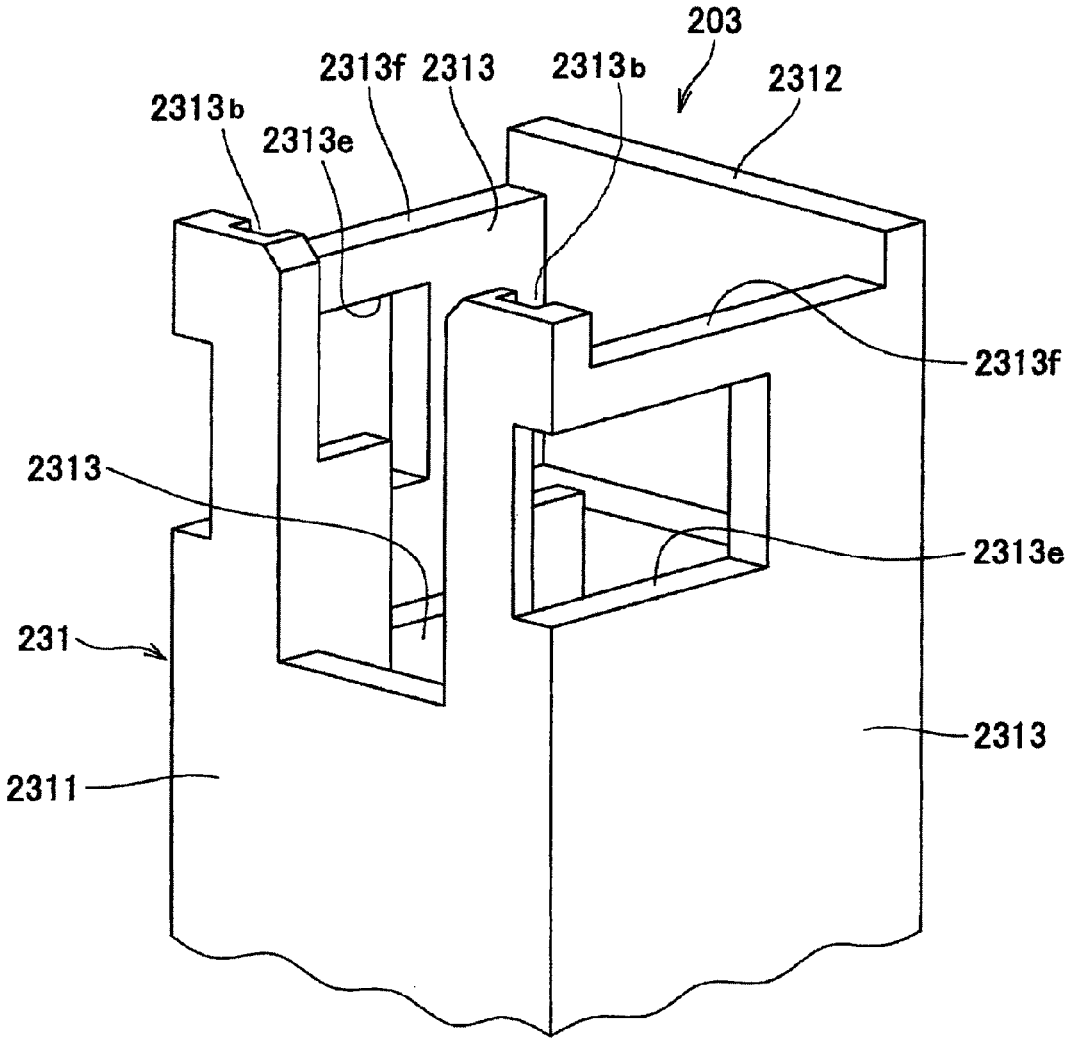
FIG. 11 is a perspective view of part of a housing of a connector according to a second embodiment of the present invention.
Figure 12:
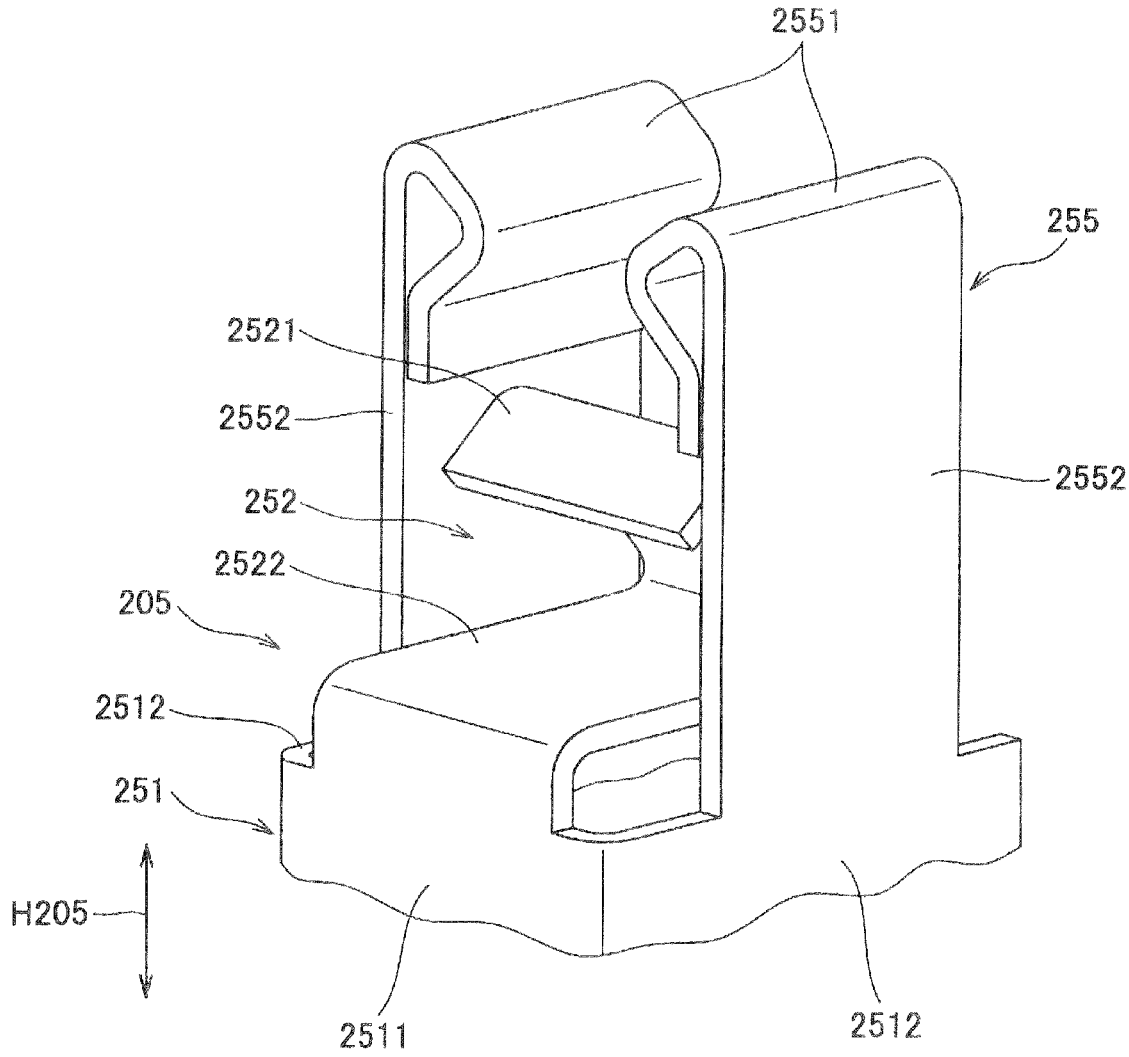
FIG. 12 is a perspective view of part of a contact of the connector.
Figure 13:
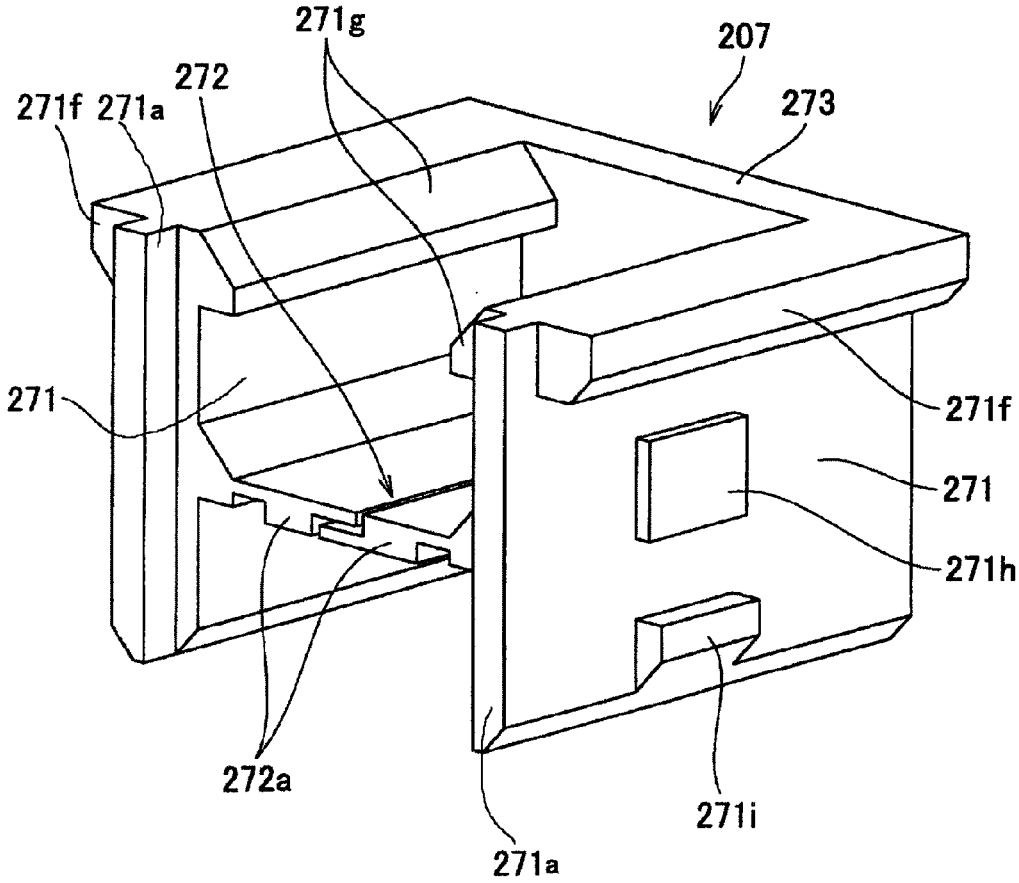
FIG. 13 is a perspective view of a slider of the connector.

FIG. 11 is a perspective view of part of a housing 203 of a connector 201 according to a second embodiment of the present invention. FIG. 12 is a perspective view of part of a contact 205 of the connector 201. FIG. 13 is a perspective view of a slider 207 of the connector 201.

Component parts identical to those of the connector 1 according to the above-described first embodiment are denoted by identical reference numerals, and detailed description thereof is omitted, while only main component parts different in construction from those of the first embodiment will be described hereinafter.

As shown in FIG. 11, a housing body 231 of the housing 203 is comprised of a front board 2311, a rear board 2312, and two side boards 2313. Each side board 2313 has an upper portion formed with a window hole 2313*e*. Further, each side board 2313 has a upper end formed with a recess 2313*f*. The structure of part of the housing 203 which is not shown is similar to that of corresponding part the housing 3 according to the first embodiment.

The front board 2311 has an inner surface provided with two guiding grooves 2313*b* in which the two protruding portions (guiding portions) 271*a* of the slider 207 (see FIGS. 13 and 14), referred to hereinafter, are slidably fitted.

As shown in FIG. 12, the contact 205 includes a barrel portion 251, a board connection portion 252, and a sandwiching portion 255.

The barrel portion 251 is comprised of a front board 2511 and two side boards 2512.

The board connection portion 252 is comprised of a contact portion 2521 and a spring portion 2522. The spring portion 2522 has one end continuous to the contact portion 2521, and the other end continuous to the front board 2511. The spring portion 2522 is elastically deformable in a direction H21 of the thickness of the inverter board 21 (see FIG. 16) accommodated in the accommodating space 315 (see FIG. 16).

The sandwiching portion 255 is comprised of protruding portions 2551 and spring portions 2552. The protruding portions 2551 sandwich the inserting portion 21*a* of the inverter board 21 in a direction W21*a* (see FIG. 16) of the width of the inserting portion 21*a* of the inverter board 21 which is accommodated in the accommodating space 315. One end of each spring portion 2552 is continuous to the protruding portion 2551, and the other end thereof is continuous to the side board 2512. The spring portions 2552 are elastically deformable in the direction W21*a* of the width of the inserting portion 21*a* of the inverter board 21 which is accommodated in the accommodating portion 315. The structure of part of the contact 205 which is not shown is similar to that of corresponding part the contact 5 according to the first embodiment.

The slider 207 is comprised of two side wall portions 271, an opening/closing lid portion 272, and a rear wall portion 273. The slider 207 is integrally molded of a synthetic resin having flexibility. Each side wall portion 271 has an upper end which has a first projecting portion 271*f* formed on an outer surface thereof and a projecting portion 271*g* formed on an inner surface thereof. Further, each side wall portion 271 has an outer surface formed with a first protruding portion 271*h* and a second protruding portion 271*i*. Furthermore, each side wall portion 271 has a front end provided with a protruding portion 271*a* extending in a vertical direction. The opening/closing lid portion 272 is comprised of two projecting portions 272*a*. The projecting portions 272*a* are formed on the inner surfaces of the side wall portions 271, respectively. The projecting portions 272*a* project in the direction coming closer to each other, and closes the opening 315*a* (see FIG. 14). Each projecting portion 272*a* is elastically deformable such that it is capable of being bent into substantially 90° about its fixed end. When the two projecting portions 272*a* are elastically deformed, the opening 315*a* (see FIG. 14) is opened. The rear wall portion 273 is continuous to the rear ends of the side wall portions 271.

Figure 14:
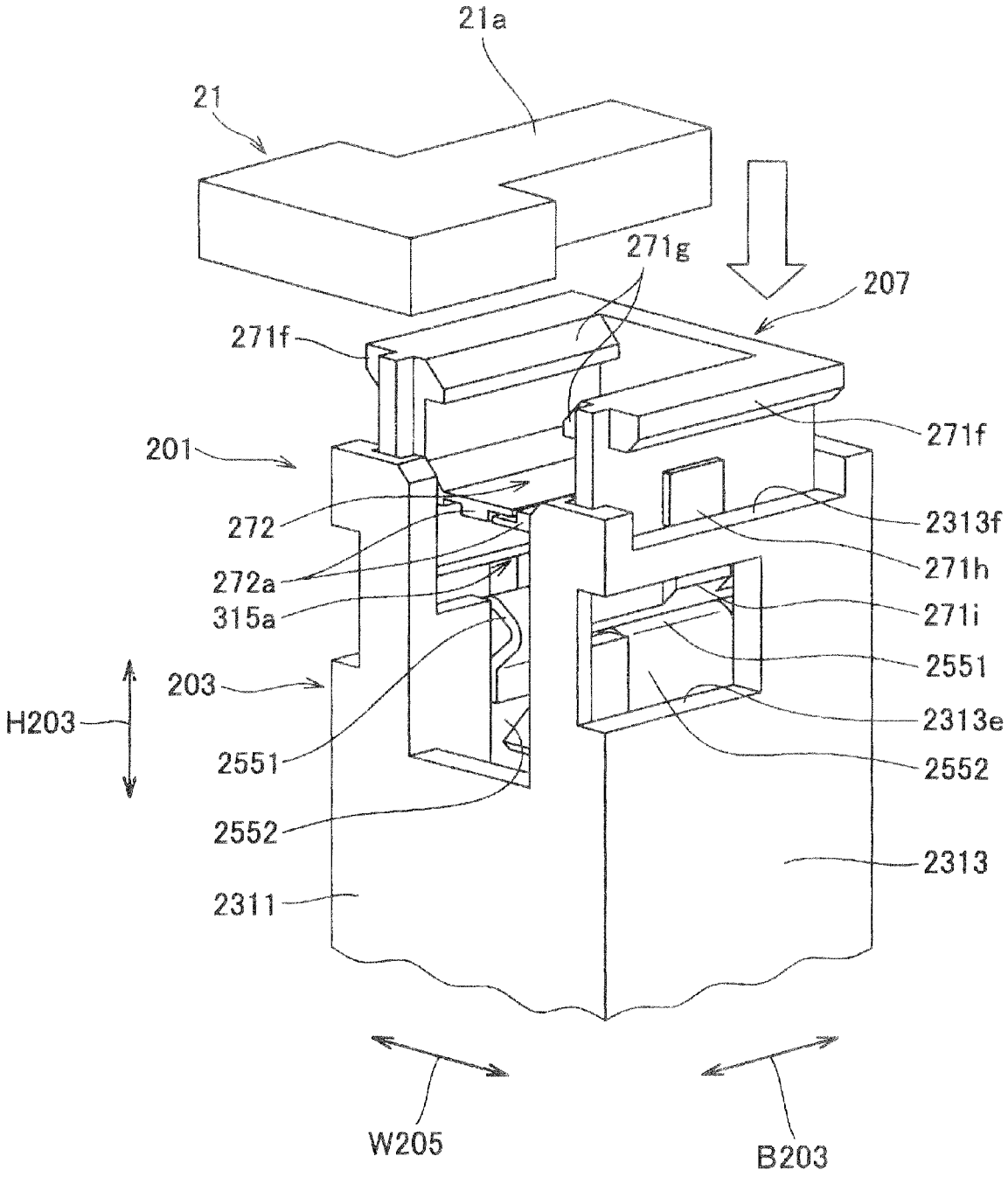
FIG. 14 is a perspective view of the connector according to the second embodiment and the inverter board in a state before the inverter board is been connected to the connector.

To connect the inverter board 21 to the connector 201, first, the slider 207 is set to the opening position, as shown in FIG. 14. At this time, the first protruding portions 271*h* are brought into abutment with the bottom surfaces of the recesses 2313*f* of the housing 203, respectively, and hence the slider 207 is maintained in the opening position. Further, even if the slider 207 is pulled upward, the second protruding portions 271*i* are brought into abutment with the inner peripheral surfaces of the window holes 2313*e*, and hence the slider 207 cannot be pulled out from the housing 203.

Next, the inserting portion 21*a* of the inverter board 21 is inserted into the accommodating space 315 (see FIG. 16) along a direction H203 of the height of the housing 203. At this time, the inserting portion 21*a* pushes the opening/closing lid portion 272 open to pass therethrough. Although the spacing between the two protruding portions 2551 is set narrower than the width of the inserting portion 21*a* of the inverter board 21, the spring portions 2552 are elastically deformable in the direction W21*a* of the width of the inserting portion 21*a*, and hence the inserting portion 21*a* of the inverter board 21 is capable of pushing the two protruding portions 2551 open to pass through therebetween. It should be noted that it is also possible to insert the inserting portion 21*a* of the inverter board 21 in the accommodating space 315 along a front-rear direction B203 of the housing 3 without passing through the protruding portions 2551.

Figure 15:
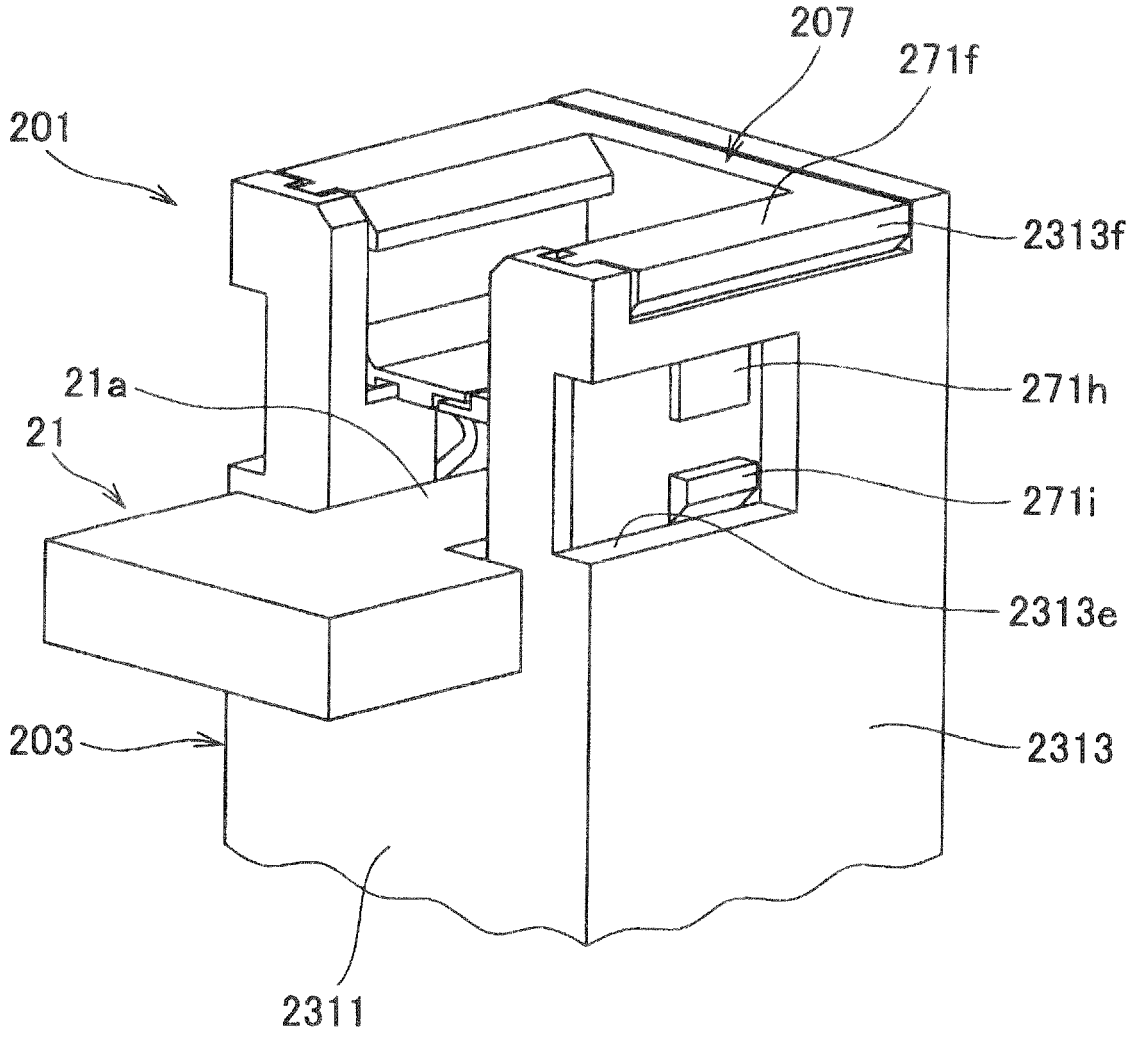
FIG. 15 is a perspective view of the connector appearing in FIG. 14 and the inverter board in a state in which the inverter board is connected to the connector appearing in FIG. 14.
Figure 16:
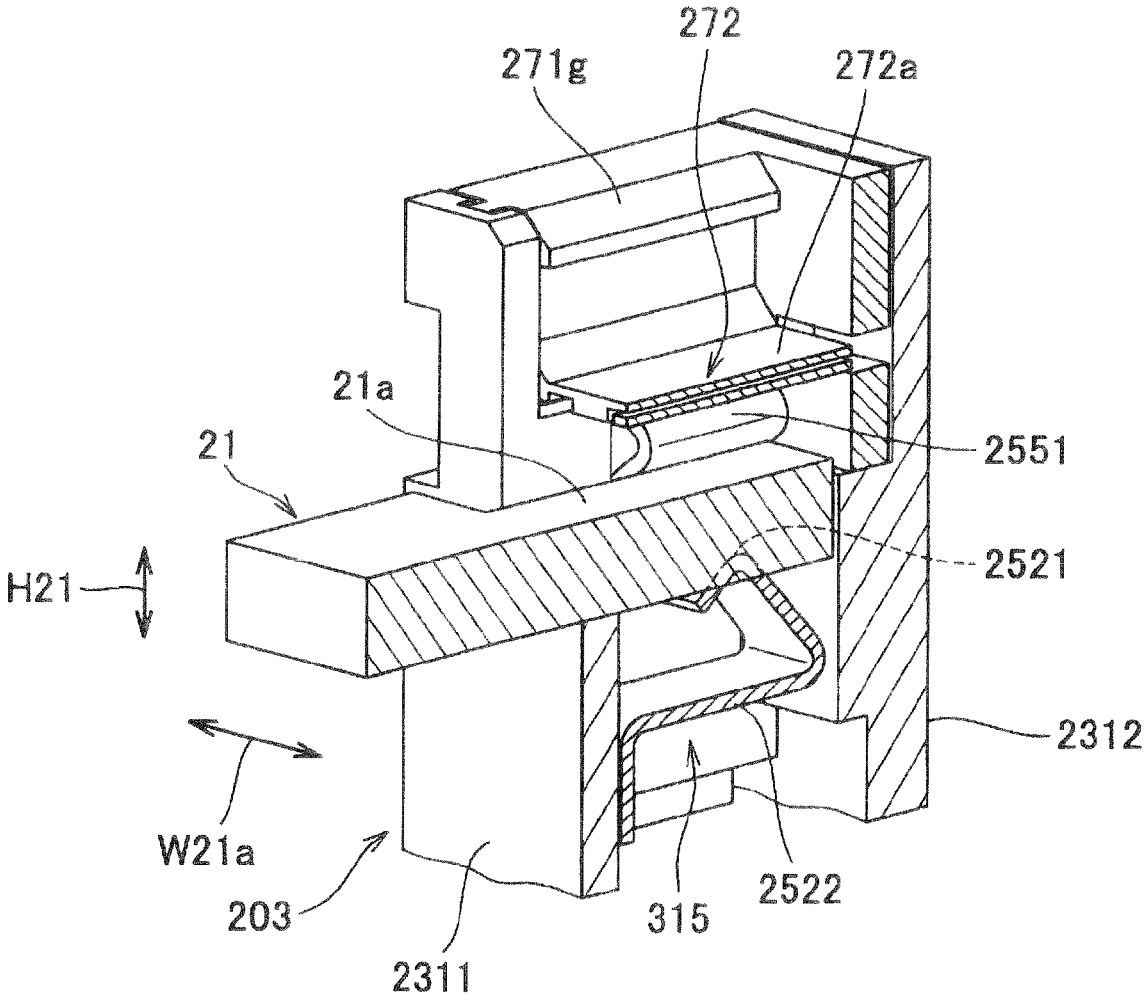
FIG. 16 is a perspective view, partly in cross-section, of the connector appearing in FIG. 14 and the inverter board in a state in which the inverter board is connected to the connector.
Figure 17:
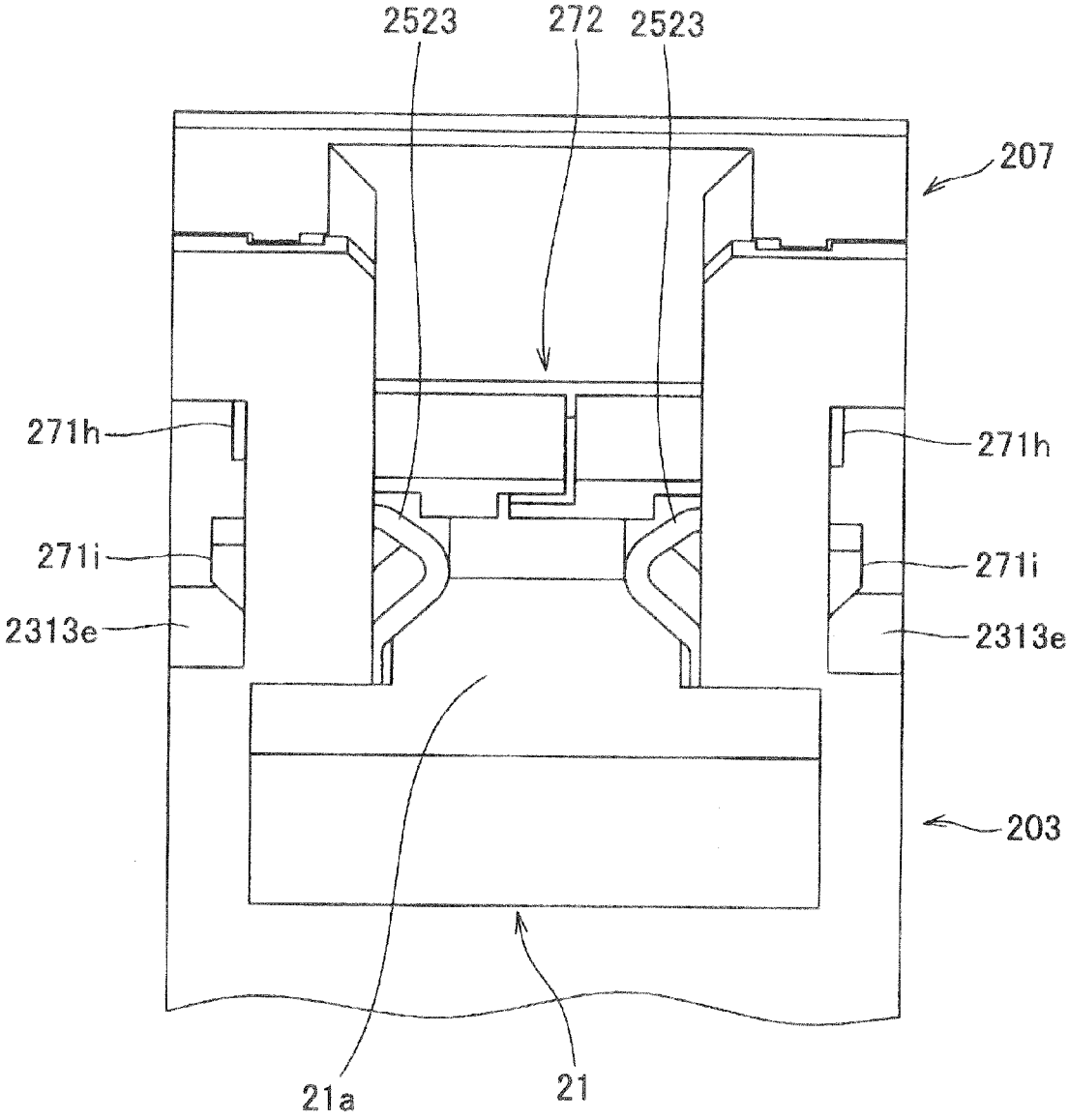
FIG. 17 is a perspective view of the connector appearing in FIG. 14 and the inverter board in a state in which the inverter board is connected to the connector, as taken obliquely from the above.

Subsequently, as shown in FIGS. 15 and 16, the slider 207 is slid downward. As a result, the first projecting portions 271*f* of the slider are fitted in the recesses 2313*f* of the housing 203, respectively, and the first protruding portions 271*h* are fitted in the window holes 2313*e* of the housing 203. Further, the side wall portion s271 of the slider 207 are fitted in between the spring portions 2552 of the contact 205 and the respective associated side boards 2313 of the housing 203, which makes the spring portion 2552 incapable of being elastically deformed in the direction W21*a* of the width of the inserting portion 21*a*, thereby preventing the spacing between the two protruding portions from being widened. As a consequence, the inserting portion 21*a* of the inverter board 21 cannot be pulled out of the accommodating space 315 in the direction H203 of the height of the housing 203. Further, the inserting portion 21*a* accommodated in the accommodating space 315 is pushed against the contact portion 2521 by the protruding portions 2551. As a result, the board connection portion 252 of the contact 205 and the inverter board 21 are electrically connected to each other.

According to the second embodiment, the same advantageous effects as provided by the first embodiment are obtained.

It should be noted that although in the above-described first embodiment, it is possible to insert the inserting portion 21*a* of the inverter board 21 in the accommodating portion 315 from two directions, it is only necessary that the inserting portion 21*a* can be inserted in the accommodating portion 315 from one direction of the housing.

Further, although in the above-described second embodiment, it is possible to insert the inserting portion 21*a* of the inverter board 21 in the accommodating portion 315 from two directions, it is only necessary to that the inserting portion 21*a* can be inserted in the accommodating portion 315 from the direction H203 of the height of the housing 203.

Although the sliders 7 and 207 are formed as resin-made sliders in the first and the second embodiments, the sliders 7 and 207 may be formed of a metal, insofar as they can maintain insulation properties between the upper surface of the inverter board 21 and the contacts 5, 205.

It is further understood by those skilled in the art that the foregoing are the preferred embodiments of the present invention, and that various changes and modification may be made thereto without departing from the spirit and scope thereof.

What is claimed is:

1. A connector comprising:

a housing comprising an accommodating portion into which a part of a board is insertable, said accommodating portion having an opening for receiving said part of said board;

a contact comprising a contact portion which is capable of being brought into contact with said part of said board accommodated in said accommodating portion, and which is held by said housing; and a slider which is mounted on said housing in a slidable manner between an opening position at which the opening of said accommodating portion is opened and a closing position at which the opening of said accommodating portion is closed;

wherein said slider brings said contact portion out of contact with said part of said board, which is directly engaged with said contact portion and inserted into said accommodating portion, in a thickness direction of said board when said slider is at the opening position, and said slider brings said contact portion into contact with said part of said board, which is inserted into said accommodating portion, in the thickness direction of said board when said slider is at the closing position; and wherein said contact comprises a guiding portion for guiding said slider in a sliding direction thereof.

2. A connector as claimed in claim 1, wherein said housing comprises a guiding portion for guiding said slider in the sliding direction thereof.

3. A connector as claimed in claim 2, wherein said slider comprises a lid portion that opens and closes the opening by sliding.

4. A connector as claimed in claim 1, wherein said slider comprises a cam surface for moving said contact portion in the thickness direction; and wherein said contact comprises an engaging portion which is engagable with said cam surface.

5. A connector as claimed in claim 4, wherein said slider comprises a lid portion that opens and closes the opening by sliding.

6. A connector as claimed in claim 4, wherein said housing comprises a guiding portion for guiding said slider in the sliding direction thereof.

7. A connector as claimed in claim 6, wherein said slider comprises a lid portion that opens and closes the opening by sliding.

8. A connector comprising:

a housing comprising an accommodating portion into which a part of a board is insertable, said accommodating portion having an opening for receiving said part of said board;

a contact comprising a contact portion which is capable of being brought into contact with said part of said board accommodated in said accommodating portion, and which is held by said housing; and a slider which is mounted on said housing in a slidable manner between an opening position at which the opening of said accommodating portion is opened and a closing position at which the opening of said accommodating portion is closed;

wherein said slider brings said contact portion out of contact with said part of said board, which is directly engaged with said contact portion and inserted into said accommodating portion, in a thickness direction of said board when said slider is at the opening position, and said slider brings said contact portion into contact with said part of said board, which is inserted into said accommodating portion, in the thickness direction of said board when said slider is at the closing position; and wherein said slider comprises a lid portion that opens and closes the opening by sliding.

9. A connector as claimed in claim 8, wherein said housing comprises a guiding portion for guiding said slider in a sliding direction thereof.

10. A connector as claimed in claim 8, wherein said slider comprises a cam surface for moving said contact portion in the thickness direction; and wherein said contact comprises an engaging portion which is engagable with said cam surface.

11. A connector as claimed in claim 10, wherein said housing comprises a guiding portion for guiding said slider in a sliding direction thereof.

12. A connector comprising:

a housing comprising an accommodating portion into which a part of a board is insertable in a thickness direction of said board, and an opening for receiving said part of said board in said accommodating portion in the thickness direction of said board;

a contact comprising a contact portion which is capable of being brought into contact with said part of said board inserted in said accommodating portion, and a sandwiching portion for sandwiching said part of said board inserted in said accommodating portion and pushing said part against said contact portion, the contact being held by said housing; and a slider that is mounted on said housing in a slidable manner between an opening position at which the opening is opened and a closing position at which the opening is closed, the slider maintaining a state in which said part of said board is sandwiched by said sandwiching portion when said slider is at the closing position, and releasing the state in which said part of said board is sandwiched by said sandwiching portion when said slider is at the opening position.

13. A connector as claimed in claim 12, wherein said housing comprises a guiding portion for guiding said slider in a sliding direction thereof.

14. A connector as claimed in claim 12, wherein said slider comprises a lid portion that opens and closes the opening by insertion and removal of said part of said board into and from said accommodating portion of said housing.

* * * * *